US012808118B2

(12) United States Patent
Sakurada et al.

(10) Patent No.: US 12,808,118 B2
(45) Date of Patent: Nov. 24, 2026

(54) PAPER PIECE SUPPLY DEVICE AND SHEET MANUFACTURING APPARATUS

(71) Applicant: SEIKO EPSON CORPORATION, Tokyo (JP)

(72) Inventors: Jun Sakurada, Sakata (JP); Makoto Sato, Matsumoto (JP); Koji Motohashi, Matsumoto (JP); Karen Hasebe, Azumino (JP); Takashi Abe, Sakata (JP)

(73) Assignee: Seiko Epson Corporation, Tokyo (JP)

( * ) Notice: Subject to any disclaimer, the term of this patent is extended or adjusted under 35 U.S.C. 154(b) by 202 days.

(21) Appl. No.: 18/939,595

(22) Filed: Nov. 7, 2024

(65) Prior Publication Data

US 2025/0154720 A1 May 15, 2025

(30) Foreign Application Priority Data

Nov. 9, 2023 (JP) ..... 2023-191397

(51) Int. Cl.
*D21B 1/08* (2006.01)
*D21F 9/00* (2006.01)

(52) U.S. Cl.
CPC ..... *D21B 1/08* (2013.01); *D21F 9/00* (2013.01)

(58) Field of Classification Search
None
See application file for complete search history.

(56) References Cited

U.S. PATENT DOCUMENTS 4,105,494 A * 8/1978 Pettersson ..... B01F 27/808 162/49

FOREIGN PATENT DOCUMENTS

JP 2020-203256 A 12/2020

* cited by examiner

*Primary Examiner* — Rita P Adhlakha
(74) *Attorney, Agent, or Firm* — Spencer Fane LLP

(57) ABSTRACT

A paper piece supply device includes a storage unit that stores paper pieces, a tube that discharges the paper pieces from the storage unit, a motor that rotates the tube, and a fixed portion positioned inside the tube and not movable with rotation of the tube.

8 Claims, 11 Drawing Sheets

PAPER PIECE SUPPLY DEVICE AND SHEET MANUFACTURING APPARATUS

The present application is based on, and claims priority from JP Application Serial Number 2023-191397, filed Nov. 9, 2023, the disclosure of which is hereby incorporated by reference herein in its entirety.

BACKGROUND

1. Technical Field

The present disclosure relates to a paper piece supply device and a sheet manufacturing apparatus.

2. Related Art

In the related art, a sheet manufacturing apparatus for manufacturing a sheet or the like by compression-forming fibers obtained from paper pieces or the like has been known. Some of such apparatuses include a raw material supply mechanism including a storage unit that stores paper pieces and a discharge pipe that discharges the paper pieces downstream from the storage unit. For example, JP-A-2020-203256 discloses a stirring apparatus including a discharge pipe that transports fiber pieces from a storage unit to a measuring unit.

However, in the apparatus described in JP-A-2020-203256, there is a problem in which it is difficult to improve the transportability of the fiber pieces, which are paper pieces. As a result of investigation by the present inventors, it has been found that there is room for further improvement in transportability. Specifically, the fiber pieces are transported from a storage unit having a relatively large volume through a discharge pipe having a volume smaller than that of the storage unit. Therefore, depending on the amount of the fiber pieces introduced into the discharge pipe, the stirring state of the storage unit, the rotation state of the discharge pipe, and the like, there is a possibility that the fiber pieces are sent out in a lump shape. When the fiber pieces clump together, a transport path may be clogged or the quality of a manufactured sheet may be deteriorated.

SUMMARY

A paper piece supply device includes a storage unit that stores paper pieces, a tube that discharges the paper pieces from the storage unit, a motor that rotates the tube, and a fixed portion positioned inside the tube and not movable with rotation of the tube.

A sheet manufacturing apparatus includes the paper piece supply device described above, a defibrating unit that defibrates the paper pieces discharged from the tube to produce fibers, an accumulation unit in which the fibers accumulate and form a web in air, and a forming unit that compresses the web to form a sheet.

BRIEF DESCRIPTION OF THE DRAWINGS

FIG. 4 is a side sectional view illustrating an arrangement of a movable portion, a fixed portion, and the like.

FIG. 5 is a perspective sectional view illustrating the arrangement of the movable portion, the fixed portion, and the like.

DESCRIPTION OF EMBODIMENTS

In the following embodiment, a raw material supply device 13 that supplies paper pieces of, for example, used paper and a sheet manufacturing apparatus 1 that manufactures a sheet by a dry method from the paper pieces supplied from the raw material supply device 13 will be exemplified and described with reference to the drawings. In the present embodiment, the raw material supply device 13 is included in the sheet manufacturing apparatus 1. The sheet manufacturing apparatus of the present disclosure is not limited to a dry type and may be a wet type. In the present specification, "dry type" means not to be performed in a liquid but to be performed in air such as the atmosphere.

In each of the following drawings, where necessary, an F axis and XYZ axes as coordinate axes orthogonal to each other are given, a direction indicated by each arrow is set as a positive direction, and a direction opposite to the positive direction is set as a negative direction. A +F direction is a transport direction of paper pieces transported inside a movable portion described later. The F axis intersects the XYZ axes. The Z axis is a virtual axis extending in a vertical direction, a +Z direction is an upward direction, and a −Z direction is a downward direction. A −Z direction is a direction in which gravity acts.

In the raw material supply device 13 and the sheet manufacturing apparatus 1, a leading side in the transport direction of paper pieces, a web, a sheet, or the like may be referred to as downstream, and a going-back side in the transport direction may be referred to as upstream. For convenience of illustration, the size of each member is different from the actual size.

Figure 1:
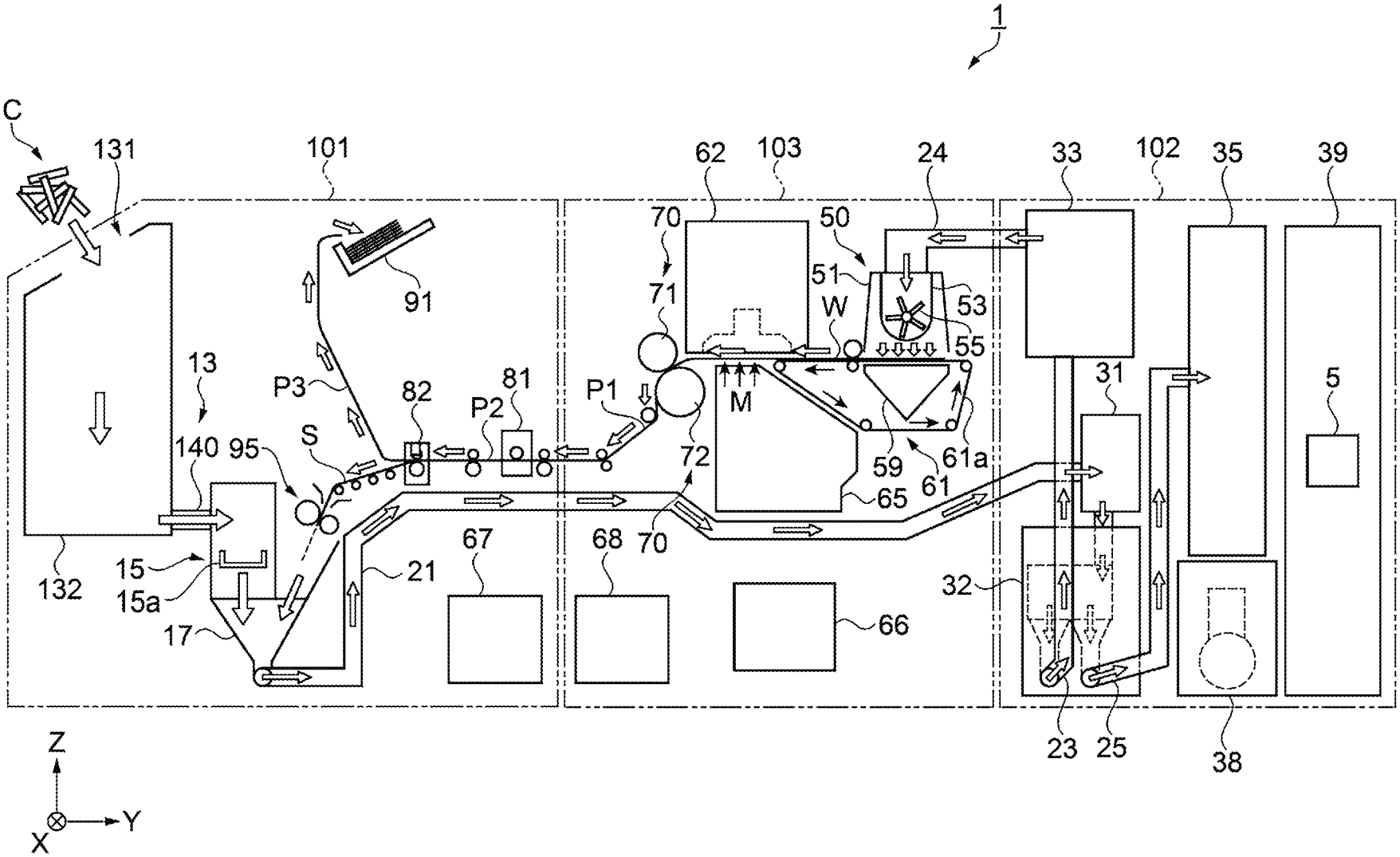
FIG. 1 is a schematic diagram illustrating a configuration of a sheet manufacturing apparatus according to an embodiment.

As illustrated in FIG. 1, the sheet manufacturing apparatus 1 according to the present embodiment has a first unit group 101, a second unit group 102, and a third unit group 103. The first unit group 101, the second unit group 102, and the third unit group 103 are supported by a frame (not illustrated). In FIG. 1, directions in which paper pieces C, a sheet P3, a slit piece S, an unnecessary scrap, and the like move are indicated by white arrows. In the following description, an aggregate of a plurality of paper pieces C is also simply referred to as the paper pieces C.

The sheet manufacturing apparatus 1 manufactures the sheet P3 from the paper pieces C. In the sheet manufacturing apparatus 1, the first unit group 101, the third unit group 103, and the second unit group 102 are arranged from a −Y direction to a +Y direction in side view in a −X direction.

The paper pieces C are transported from the first unit group 101 to the second unit group 102 through a pipe 21 passing through the third unit group 103. Then, the paper pieces C are subjected to defibration or the like in the second unit group 102 to become fibers and then become a mixture containing a binding material or the like. The mixture is transported to the third unit group 103 through a pipe 24. The mixture forms a web W in the third unit group 103 and then forms a strip-shaped sheet P1. The strip-shaped sheet P1 is cut into the sheet P3 in the first unit group 101.

The first unit group 101 includes the raw material supply device 13, a measuring unit 15, a merging unit 17, and the pipe 21. In the first unit group 101, these components are arranged in this order from upstream to downstream. In addition, the first unit group 101 also includes a first cutting unit 81, a second cutting unit 82, a tray 91, and a shredding unit 95. The first cutting unit 81 and the second cutting unit 82 cut the strip-shaped sheet P1 into the sheet P3 having a predetermined shape. Further, the first unit group 101 includes a water supply unit 67. The water supply unit 67 is a water storage tank. The water supply unit 67 supplies water for humidification to each of a first humidification unit 65 and a second humidification unit 66, which will be described later, through a water supply pipe (not illustrated).

The raw material supply device 13 stores the paper pieces C, which are a row material of the sheet P3, and supplies the paper pieces C downstream. The raw material supply device 13 includes a raw material input port 131, a storage unit 132, and a discharge unit 140.

The paper pieces C are input from the raw material input port 131 to the storage unit 132. The paper pieces C contain fibers such as cellulose and are, for example, shredded used paper. Humidified air is supplied to an inside of the storage unit 132 from the second humidification unit 66 provided in the third unit group 103.

The paper pieces C are temporarily stored in the storage unit 132 and then transported to the measuring unit 15 through the discharge unit 140. The sheet manufacturing apparatus 1 may include a shredder for shredding the paper pieces C or the like upstream of the storage unit 132. Details of the raw material supply device 13 will be described later.

The measuring unit 15 includes a sensor unit 15*a* and a supply mechanism (not illustrated). The sensor unit 15*a* weighs the mass of the paper pieces C. The supply mechanism supplies the paper pieces C weighed by the sensor unit 15*a* to the downstream merging unit 17. That is, the measuring unit 15 weighs the paper pieces C for each predetermined mass by the sensor unit 15*a* and supplies the paper pieces C to the downstream merging unit 17 by the supply mechanism.

Both a digital weighing mechanism and an analog weighing mechanism can be applied to the sensor unit 15*a*. Specific examples of the sensor unit 15*a* include a physical sensor, such as a load cell, a spring scale, and a balance. In the present embodiment, a load cell is used as the sensor unit 15*a*. The predetermined mass for which the paper pieces C are weighed by the sensor unit 15*a* is, for example, approximately several grams to several tens of grams.

A known technique such as an openable/closable feeder can be applied to the supply mechanism. The supply mechanism may be included in the sensor unit 15*a*.

The paper pieces C are weighed and supplied in the measuring unit 15 by batch processing. That is, the paper pieces C are supplied intermittently from the measuring unit 15 to the merging unit 17. The measuring unit 15 may include a plurality of combinations of the sensor unit 15*a* and the supply mechanism, and the plurality of sensor units 15*a* may be operated at different times to improve the weighing and supplying efficiencies. The sheet manufacturing apparatus 1 includes two sensor units 15*a* and supply mechanisms attached to the respective sensor units 15*a*. As a result, the paper pieces C are alternately transported from the two pairs of the sensor unit 15*a* and the supply mechanism to the merging unit 17.

In the merging unit 17, shredded pieces of the slit piece S supplied from the shredding unit 95 are merged and mixed with the paper pieces C supplied from the measuring unit 15. The slit piece S and the shredding unit 95 will be described later. The paper pieces C mixed with the above-described shredded pieces flow into the pipe 21 from the merging unit 17.

The pipe 21 transports the paper pieces C from the first unit group 101 to the second unit group 102 by a suction airflow generated by a defibrating unit 31 downstream.

The second unit group 102 includes the defibrating unit 31, which is a dry type defibrator, a separator 32, a pipe 23, a mixing unit 33, and the pipe 24. In the second unit group 102, these components are arranged in this order from upstream to downstream. In addition, the second unit group 102 also includes a pipe 25 coupled to the separator 32, a collection unit 35, a compressor 38, and a power supply unit 39.

The paper pieces C transported through the pipe 21 flow into the defibrating unit 31. The defibrating unit 31 defibrates the paper pieces C supplied from the measuring unit 15 into fibers by a dry type method. A known defibrating mechanism can be applied to the defibrating unit 31.

The defibrating unit 31 has the following configuration, for example. The defibrating unit 31 includes a stator and a rotor. The stator has a substantially cylindrical inner surface. The rotor is installed inside the stator and rotates along the inner surface of the stator. Small pieces of the paper pieces C are held between the inner surface of the stator and the rotor and are defibrated by a shearing force generated therebetween. In this manner, entangled fibers included in the paper pieces C are untangled. The paper pieces C become fibers and are transported to the separator 32.

The separator 32 separates the defibrated fibers. Specifically, the separator 32 removes components that are contained in the fibers and that are unnecessary for manufacturing the sheet P3. That is, the separator 32 separates relatively long fibers from relatively short fibers. Since relatively short fibers may cause a decrease in strength of the sheet P3, the fibers are sorted out by the separator 32. In addition, the separator 32 also sorts out and removes coloring materials and additives contained in the paper pieces C. A known technique such as a disk mesh method can be applied to the separator 32.

Humidified air is supplied to an inside of the separator 32 from the second humidification unit 66 of the third unit group 103.

Relatively short fibers and the like are removed from the defibrated fibers, and the defibrated fibers are transported to the mixing unit 33 through the pipe 23. Unnecessary components such as relatively short fibers and coloring materials are discharged through the pipe 25 to the collection unit 35.

The mixing unit 33 mixes the fibers with a binding material or the like in the air to produce a mixture. Although not illustrated, the mixing unit 33 includes a flow path through which the fibers are transported, a fan, a hopper, a supply pipe, and a valve.

The hopper is in communication with the flow path of the fibers through the supply pipe. The valve is provided in the supply pipe between the hopper and the flow path. The hopper supplies a binding material such as starch into the flow path. The valve adjusts the mass of the binding material supplied from the hopper to the flow path. As a result, the ratio at which the fibers and the binding material are mixed is adjusted.

In addition to the above-described components for supplying the binding material, the mixing unit 33 may include a similar component for supplying coloring materials, additives, or the like.

The fan of the mixing unit 33 generates an airflow to mix the binding material and the like in the air to produce a mixture while transporting the fibers downstream. The mixture flows into the pipe 24 from the mixing unit 33.

The collection unit 35 includes a filter (not illustrated). The filter filters out unnecessary components such as relatively short fibers transported through the pipe 25 by an airflow.

The compressor 38 generates compressed air. In the above-described filter, clogging may occur due to fine particles or the like of the unnecessary components. The filter can be cleaned through blowing of compressed air generated by the compressor 38 onto the filter so as to blow off adhering particles.

The power supply unit 39 includes a control unit 5 and a power supply device (not illustrated) that supplies power to the sheet manufacturing apparatus 1. The power supply unit 39 distributes power supplied from the outside to each component of the sheet manufacturing apparatus 1. The control unit 5 is electrically coupled to each of the components in the sheet manufacturing apparatus 1 and integrally controls the operation of these components.

In the third unit group 103, the mixture containing fibers accumulates, is compressed, and forms the strip-shaped sheet P1 which is regenerated paper. The third unit group 103 includes an accumulation unit 50, a first transport unit 61, a second transport unit 62, the first humidification unit 65, the second humidification unit 66, a drainage unit 68, and a forming unit 70.

In the third unit group 103, the accumulation unit 50, the first transport unit 61, the second transport unit 62, the first humidification unit 65, and the forming unit 70 are arranged in this order from upstream to downstream. The second humidification unit 66 is disposed below the first humidification unit 65.

In the accumulation unit 50, the mixture containing separated fibers accumulates and forms the web W in the air. The accumulation unit 50 includes a drum member 53, a blade member 55 installed in the drum member 53, a housing 51 that accommodates the drum member 53, and a suction unit 59. The mixture is taken into the drum member 53 from the pipe 24.

The first transport unit 61 is disposed below the accumulation unit 50. The first transport unit 61 includes a mesh belt 61*a* and five tension rollers (not illustrated) for stretching the mesh belt 61*a*. The suction unit 59 faces the drum member 53 with the mesh belt 61*a* interposed therebetween in a direction along the Z axis.

The blade member 55 is disposed inside the drum member 53 and is rotationally driven by a motor (not illustrated). The drum member 53 is a semicircular columnar sieve. A mesh having a function of a sieve is provided on a side surface of the drum member 53 facing downward. The drum member 53 allows fibers and particles of the mixture or the like smaller than the size of the openings of the mesh of the sieve to pass from an inside to an outside.

The mixture is discharged to the outside of the drum member 53 while being stirred by the rotating blade member 55 in the drum member 53. Humidified air is supplied from the second humidification unit 66 to the inside of the drum member 53.

The suction unit 59 is disposed below the drum member 53. The suction unit 59 sucks air in the housing 51 through a plurality of holes of the mesh belt 61*a*. The plurality of holes of the mesh belt 61*a* allows air to pass therethrough but does not allow fibers, a binding material, and the like contained in the mixture to pass therethrough easily. As a result, the mixture discharged to the outside of the drum member 53 is sucked downward together with the air. The suction unit 59 is a known suction device such as a blower.

The mixture is dispersed in the air inside the housing 51 and accumulates on an upper surface of the mesh belt 61*a* by gravity and suction by the suction unit 59 so as to form the web W.

The mesh belt 61*a* is an endless belt and is stretched by the five tension rollers. The mesh belt 61*a* is rotated counterclockwise in FIG. 1 by rotation of the tension rollers. As a result, the mixture continuously accumulates on the mesh belt 61*a* to form the web W. The web W contains a relatively large amount of air and is soft and swollen. The first transport unit 61 transports the formed web W downstream by rotation of the mesh belt 61*a*.

The second transport unit 62 transports the web W downstream of the first transport unit 61 in place of the first transport unit 61. The second transport unit 62 peels the web W from the upper surface of the mesh belt 61*a* and transports the web W toward the forming unit 70. The second transport unit 62 is disposed above the transport path of the web W and slightly upstream of a starting point on a return side of the mesh belt 61*a*. The +Y direction of the second transport unit 62 and the −Y direction of the mesh belt 61*a* partially overlap in the vertical direction.

The second transport unit 62 includes a transport belt, a plurality of rollers, and a suction mechanism (that are not illustrated). The transport belt is provided with a plurality of holes through which air passes. The transport belt is stretched by the plurality of rollers and is rotated by rotation of the rollers.

The second transport unit 62 causes an upper surface of the web W to be sucked onto a lower surface of the transport belt by a negative pressure generated by the suction mechanism. When the transport belt rotates in this state, the web W is sucked onto the transport belt and transported downstream.

The first humidification unit 65 humidifies the web W containing fibers that accumulates in the accumulation unit 50 of the third unit group 103. Specifically, the first humidification unit 65 is, for example, a mist humidifier and humidifies the web W transported by the second transport unit 62 by supplying mist M from below the web W. The first humidification unit 65 is disposed below the second transport unit 62 and faces, in the direction along the Z axis, the web W transported by the second transport unit 62. For example, a known humidifier such as an ultrasonic humidifier can be applied to the first humidification unit 65.

When the web W is humidified with the mist M, the function of starch as a binding material is promoted, and strength of the sheet P3 is improved. In addition, since the web W is humidified from below, falling of drops derived from mist onto the web W is suppressed. Further, since the web W is humidified from a side opposite to a contact surface between the transport belt and the web W, sticking of the web W onto the transport belt is reduced. The second transport unit 62 transports the web W to the forming unit 70.

The forming unit 70 includes processing rollers 71 and 72. The processing rollers 71 and 72 compress the web W containing fibers to form the strip-shaped sheet P1. The processing rollers 71 and 72 form a pair, each of which incorporates an electric heater and has a function of increasing a temperature of a roller surface.

Each of the processing rollers 71 and 72 is a substantially columnar member. A rotation axis of the processing roller 71 and a rotation axis of the processing roller 72 are arranged along the X axis. The processing roller 71 is disposed substantially above the transport path of the web W, and the processing roller 72 is disposed substantially below the transport path. Between a side surface of the processing roller 71 and a side surface of the processing roller 72, a gap corresponding to a thickness of the sheet P3 to be manufactured is provided.

The processing rollers 71 and 72 are rotationally driven by a stepping motor (not illustrated). The web W is sent downstream while being pinched between the processing roller 71 and the processing roller 72, and heated and pressurized. That is, the web W continuously passes through the forming unit 70 and is press-formed while being heated. By using the processing rollers 71 and 72 as a pair of forming members, the web W can be efficiently heated and pressurized.

When the web W passes through the forming unit 70, the air contained in the web W is reduced from a soft state of the web W containing a relatively large amount of air, and the fibers in the web W are bonded to each other by the binding material whereby the web W forms the strip-shaped sheet P1. The strip-shaped sheet P1 is transported to the first unit group 101 by a transport roller (not illustrated).

The second humidification unit 66 is disposed below the first humidification unit 65. A known vaporization type humidifier can be applied to the second humidification unit 66. Examples of the vaporization type humidifier include a humidifier that generates humidified air by blowing air to a wetted non-woven fabric or the like to vaporize moisture.

The second humidification unit 66 humidifies a predetermined region of the sheet manufacturing apparatus 1. The predetermined region is one or more of the inside of the storage unit 132, the inside of the separator 32, and the inside of the drum member 53 of the accumulation unit 50. Specifically, the humidified air is supplied from the second humidification unit 66 to the above-described region through a plurality of pipes (not illustrated). The humidified air suppresses charging of the paper pieces C, fibers, and the like in each of the above-described components, and suppresses adhesion of the paper pieces C, fibers, and the like to members due to static electricity.

The drainage unit 68 is a drainage tank. The drainage unit 68 collects and stores old moisture that is used in the first humidification unit 65, the second humidification unit 66, and the like. The drainage unit 68 can be removed from the sheet manufacturing apparatus 1 as necessary, and the water having accumulated can be discarded.

The strip-shaped sheet P1 transported to the first unit group 101 reaches the first cutting unit 81. The first cutting unit 81 cuts the strip-shaped sheet P1 in a direction intersecting the transport direction, for example, in a direction along the X axis. The strip-shaped sheet P1 is cut into a single-cut sheet P2 by the first cutting unit 81. The single-cut sheet P2 is transported from the first cutting unit 81 to the second cutting unit 82.

The second cutting unit 82 cuts the single-cut sheet P2 in the transport direction, for example, in a direction along the Y axis. Specifically, the second cutting unit 82 cuts the single-cut sheet P2 in the vicinity of both sides in a direction along the X axis. As a result, the single-cut sheet P2 becomes the sheet P3 having a predetermined shape such as an A4 size or an A3 size.

When the single-cut sheet P2 is cut into the sheet P3 in the second cutting unit 82, the slit piece S, which is a scrap, is produced. The slit piece S is transported substantially in the −Y direction and reaches the shredding unit 95 which is a shredder. The shredding unit 95 shreds the slit piece S into shredded pieces and supplies the shredded pieces to the merging unit 17. A mechanism for weighing the shredded pieces of the slit piece S and supplying the shredded pieces to the merging unit 17 may be installed between the shredding unit 95 and the merging unit 17.

The sheet P3 is transported substantially upward and stacked on the tray 91. As described above, the sheet P3 is manufactured by the sheet manufacturing apparatus 1. The sheet P3 can be used as a substitute for, for example, copy paper.

Figure 2:
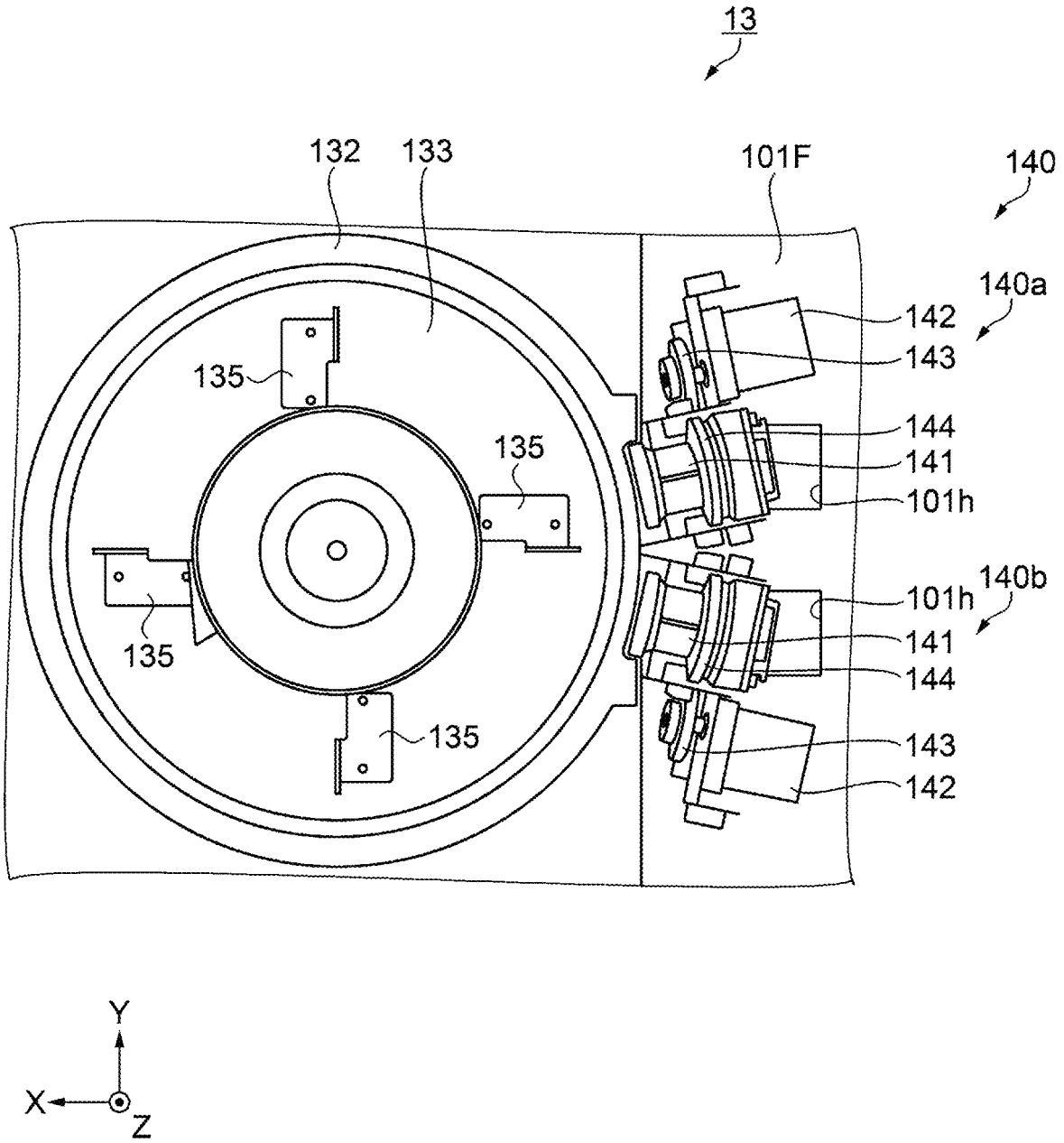
FIG. 2 is a plan view illustrating a configuration of a raw material supply device.
Figure 3:
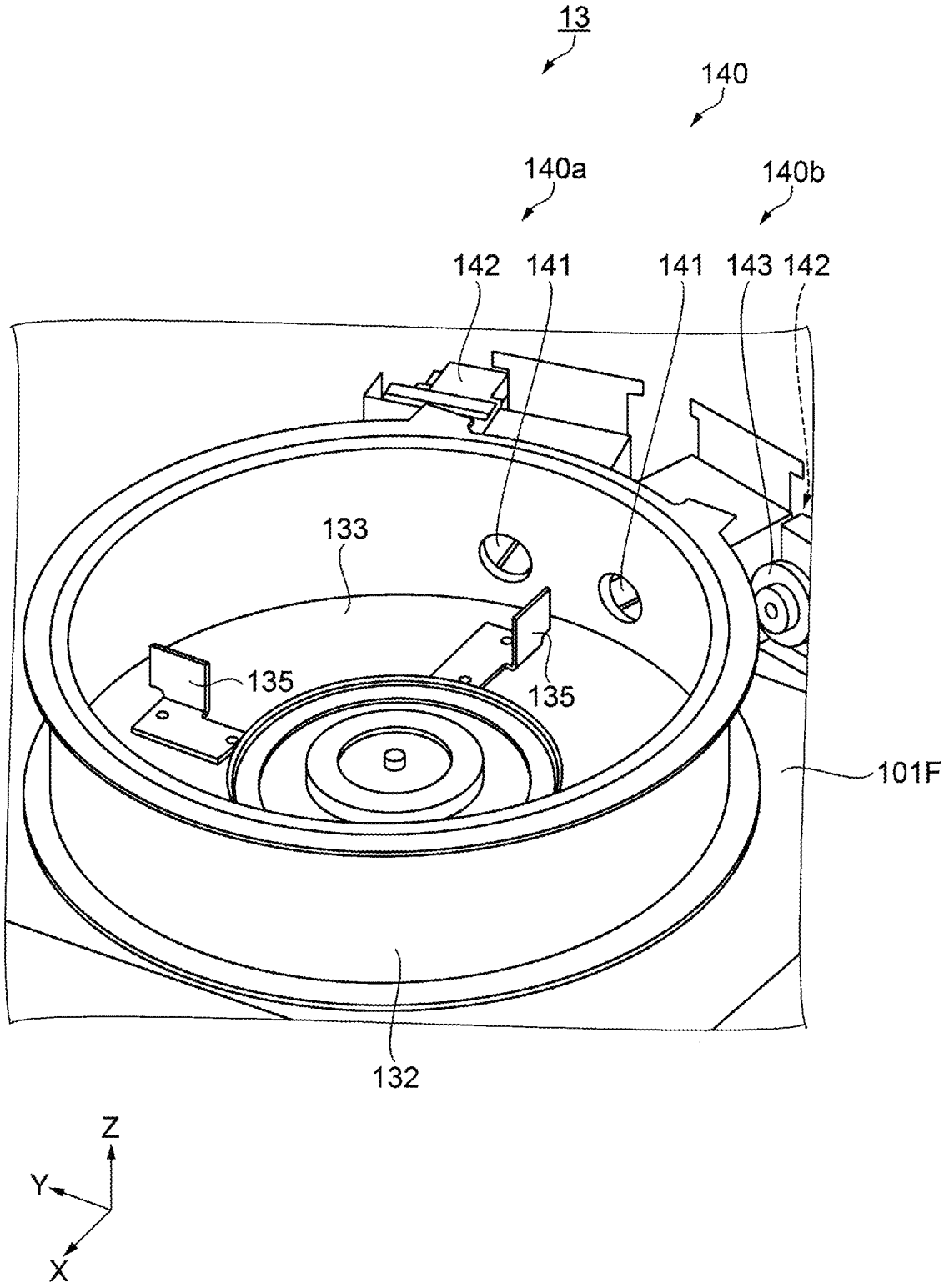
FIG. 3 is a perspective view illustrating the configuration of the raw material supply device.

As illustrated in FIGS. 2 and 3, the raw material supply device 13 includes the storage unit 132 and the discharge unit 140 disposed downstream of the storage unit 132. The discharge unit 140 includes two discharge units 140*a* and 140*b* corresponding to the two measuring units 15 described above. In FIGS. 2 and 3, components above the storage unit 132 are omitted.

The raw material supply device 13 is supported by a frame portion 101F. The frame portion 101F constitutes a part of a frame that supports the first unit group 101 described above. The frame portion 101F is provided with two opening portions 101*h* corresponding to the discharge units 140*a* and 140*b*.

The storage unit 132 stores the paper pieces C input from the above-described raw material input port 131, and also stirs and sends the paper pieces C to the discharge units 140*a* and 140*b*. The storage unit 132 has a cylindrical shape, and a length direction of the cylinder is arranged along the Z axis.

The storage unit 132 is provided with a rotary disk 133 and four blade members 135. The rotary disk 133 and the four blade members 135 are disposed in a lower bottom portion of the storage unit 132. The inside of each of movable portions 141 of the discharge units 140*a* and 140*b* is in communication with the storage unit 132 substantially in the −X direction and slightly above the above-described bottom portion.

The rotary disk 133 has a substantially disk shape and is disposed along the XY plane. The rotary disk 133 is driven by a drive motor (not illustrated) to rotate around an axis along the Z axis. The four blade members 135 are mounted on an upwardly facing surface of the rotary disk 133.

The four blade members 135 are arranged rotationally symmetrically with respect to the above-described axis along the Z axis of the rotary disk 133 in plan view from above. The blade members 135 protrude upward from an upper surface of the rotary disk 133.

When the rotary disk 133 rotates, the four blade members 135 rotate to stir the paper pieces C in the storage unit 132. As described above, humidified air is supplied from the second humidification unit 66 to the inside of the storage unit 132. When the paper pieces C are stirred in the air described above, the paper pieces C are relatively uniformly humidified. The paper pieces C are sent to the insides of two movable portions 141 while being stirred. When the paper pieces C are sent to the discharge unit 140, rotation of the rotary disk 133 is continued.

The discharge units 140*a* and 140*b* are disposed between the storage unit 132 and the two opening portions 101*h*. The opening portions 101*h* are each a substantially rectangular opening in plan view from above. The opening portions 101*h* are positioned below respective end portions of the discharge units 140*a* and 140*b* in the substantially-X direction. The discharge units 140*a* and 140*b* discharge and send the paper pieces C stored in the storage unit 132 to the measuring unit 15. The paper pieces C fall by gravity from the discharge units 140*a* and 140*b* and are introduced into each opening portion 101*h*.

The discharge units 140*a* and 140*b* are arranged in line symmetry with respect to a straight line passing through a rotation shaft of the rotary disk 133 and extending along the X axis. The configurations and functions of the discharge units 140*a* and 140*b* are the same. Therefore, in the following description, the discharge unit 140*a* of the discharge unit 140 will be described as a representative example, and the description of the discharge unit 140*b* will be omitted.

The discharge unit 140*a* includes a corresponding one of the movable portions 141 and a fixed portion 145 to be described later. The movable portion 141 has a substantially cylindrical shape, is coupled to the storage unit 132 in the −X direction, and extends substantially in the −X direction. The inside of the movable portion 141 is in communication with the inside of the storage unit 132.

The movable portion 141 is supported so as to be rotatable around a central axis of the cylinder thereof as a rotation axis. A drive unit 142, an output gear 143, and a driven gear 144 are attached to the movable portion 141.

The drive unit 142 and the output gear 143 are disposed adjacent to the movable portion 141 in the +Y direction. The drive unit 142 is an electric motor. The output gear 143 is directly coupled to an output shaft of the drive unit 142 and is rotated by driving of the drive unit 142.

The driven gear 144 is disposed on an outer periphery of the movable portion 141. A rotation axis of the driven gear 144 and the central axis of the cylinder of the movable portion 141 coincide with each other. The driven gear 144 meshes with the output gear 143 and is rotationally driven by rotation of the output gear 143 to rotate together with the movable portion 141. As a result, the movable portion 141 rotates while transporting the paper pieces C to the inside. The rotation of the movable portion 141 is stopped while the mass of the paper pieces C is measured by the corresponding measuring unit 15.

Figure 4:
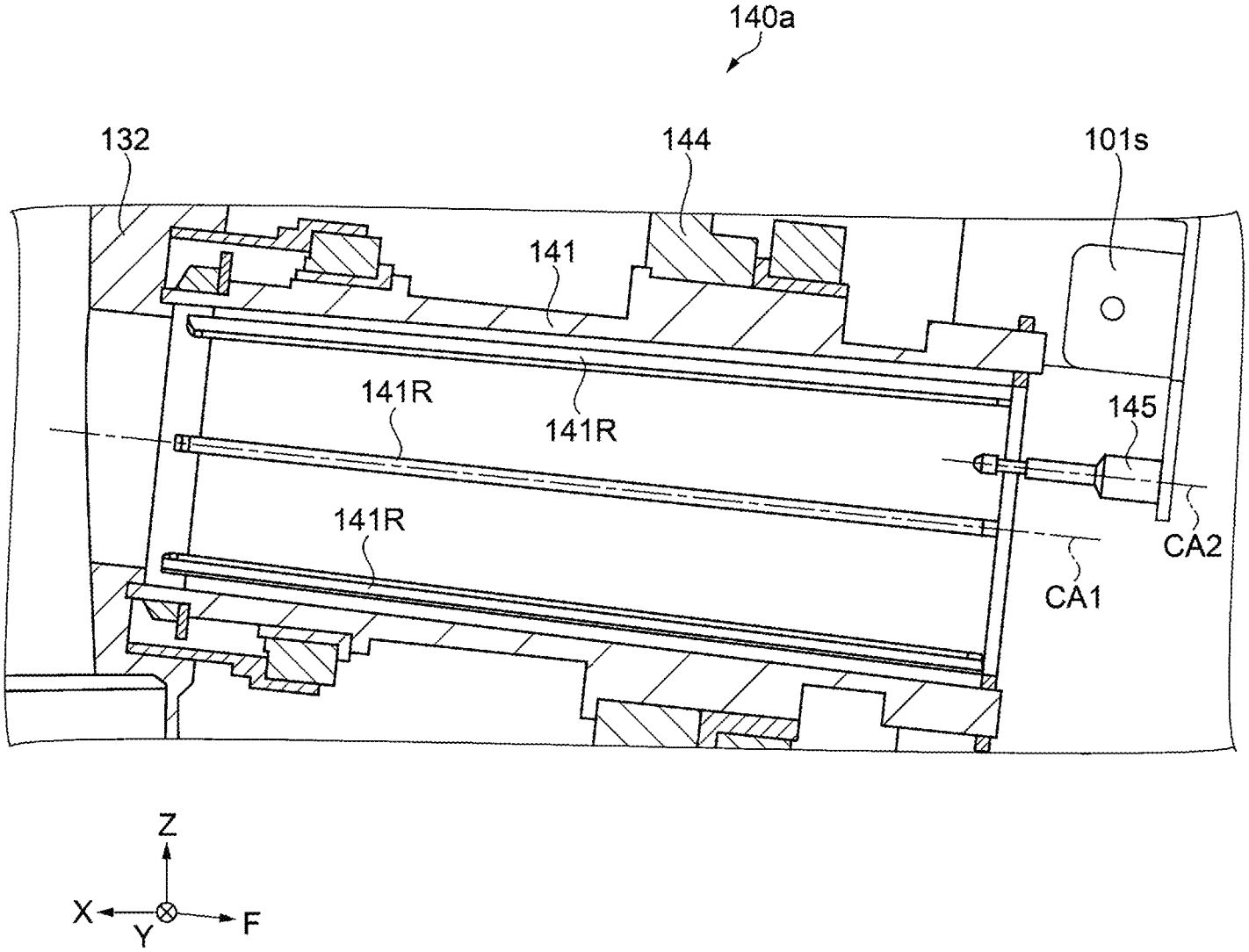

As illustrated in FIG. 4, the inside of the movable portion 141 has a shape corresponding to a side surface of a truncated cone. More specifically, when a +F direction is the transport direction of the paper pieces C transported inside the movable portion 141, an inner surface of the movable portion 141 is rotationally symmetrical with respect to an axis CA1. The axis CA1 is a central axis and is also a rotation axis of the cylinder of the movable portion 141 described above. A section orthogonal to the F axis inside the movable portion 141 is narrow on the storage unit 132 side, which is a −F direction, and is wide downstream, which is the +F direction. That is, inside the movable portion 141, the storage unit 132 side corresponds to the upper bottom surface of the truncated cone, and downstream corresponds to the lower bottom surface of the truncated cone.

Since the inside of the movable portion 141 has such a shape, the paper pieces C transported through the inside of the movable portion 141 do not easily clump together. Specifically, a force is applied to the paper pieces C transported from the storage unit 132 to the movable portion 141 by rotation of the blade members 135 and the weights of the paper pieces C. Therefore, since the inside of the movable portion 141 widens in the +F direction, the above-described force is released, a frictional force between an inner wall of the movable portion 141 and the paper pieces C is attenuated, and clogging or clumping together of the paper pieces C is suppressed.

The movable portion 141 is, for example, approximately 120 mm long along the F axis. An inner diameter of the movable portion 141 is, for example, 40 mm at the end portion in the −F direction and 45 mm at the end portion in the +F direction.

The axis CA1 extends along the F axis. The +F direction is slightly downward with respect to the −X direction. That is, the movable portion 141 is disposed so that the −X direction is inclined downward when viewed in the −Y direction.

A plurality of rib portions 141R is provided on the inner surface of the movable portion 141. Each rib portion 141R protrudes from the inner surface of the movable portion 141 toward the axis CA1. Each rib portion 141R is linearly disposed from the end portion of the movable portion 141 in the −F direction to the end portion in the +F direction. The section of each rib portion 141R orthogonal to the F axis is trapezoidal. Since the rib portion 141R has a straight line shape, the flow of the paper pieces C inside the movable portion 141 is regulated, and occurrence of clogging is suppressed. The rib portion 141R is not limited to having a linear shape. In addition, a sectional area in the above-described section of the rib portion 141R is not limited to being constant from the end portion in the −F direction to the end portion in the +F direction, and for example, the sectional area at the end portion in the +F direction may be smaller than that at the end portion in the −F direction.

In the movable portion 141, gravity due to the above-described inclined arrangement of the movable portion 141 is used to transport the paper pieces C. The paper pieces C move so as to slide down inside the movable portion 141 by gravity. In addition, when the movable portion 141 rotates, the paper pieces C are lifted in the +Z direction along the inner surface of the movable portion 141 by the rib portions 141R and then fall. Since the movable portion 141 is disposed so as to be inclined, falling points of the paper pieces C move in the +F direction, and transporting of the paper pieces C is promoted. In addition, in the above-described storage unit 132, a force that pushes the paper pieces C from the storage unit 132 to the movable portion 141 acts by rotation of the blade members 135 and the weights of the paper pieces C in the storage unit 132. This pushing force also promotes transporting of the paper pieces C in the movable portion 141.

The fixed portion 145 has the effect of dispersing and loosening the paper pieces C transported through the inside of the movable portion 141 while suppressing adhesion of the paper pieces C to the inside of the movable portion 141. The fixed portion 145 is disposed downstream, which is the +F direction, with respect to the movable portion 141. As a result, compared to a case in which the fixed portion 145 is disposed in the −F direction, which is upstream of the movable portion 141, the fixed portion 145 does not easily hinder supplying of the paper pieces C from the storage unit 132 to the inside of the movable portion 141.

The fixed portion 145 has a rod shape and is disposed such that a leading end thereof enters the inside of the movable portion 141 from the end portion side of the movable portion 141 in the +F direction. A length direction of the fixed portion 145 extends in the +F direction, which is the transport direction of the paper pieces C. That is, a central axis CA2 of the fixed portion 145 extends along the F axis.

A rear end of the fixed portion 145 is supported by a supporting member 101*s*. The fixed portion 145 is not movable with the rotation of the movable portion 141 and does not move or displace. The supporting member 101*s* is fixed to the above-described frame portion 101F.

The fixed portion 145 is installed so as to pierce the paper pieces C transported inside the movable portion 141. By the fixed portion 145, the inside of the movable portion 141 is not easily clogged with the paper pieces C, and the paper pieces C are sent downstream in a loosened state.

Figure 5:
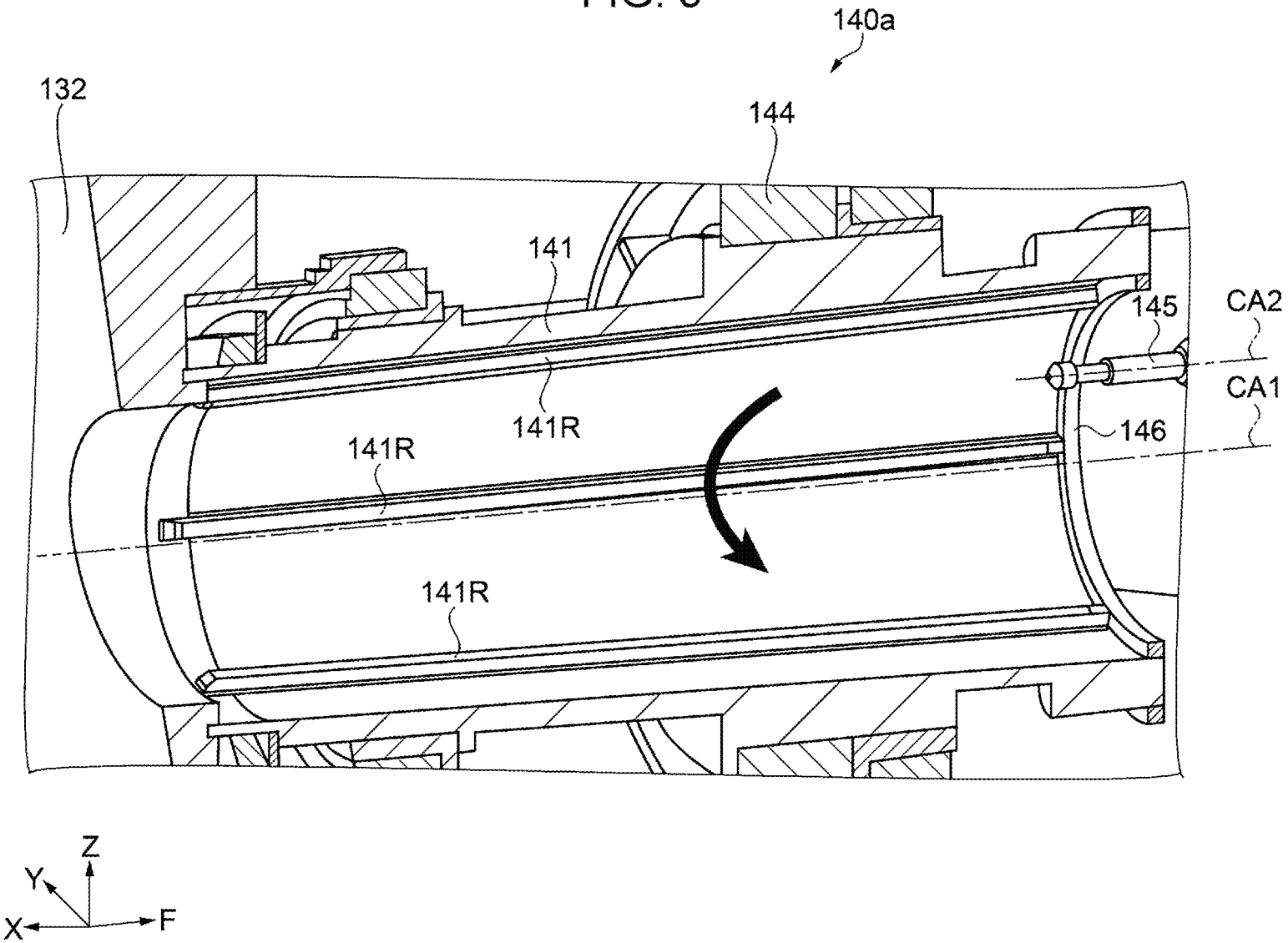

As illustrated in FIG. 5, the movable portion 141 rotates clockwise when viewed in the +F direction. A ring member 146 is disposed at an end portion of the movable portion 141 in the +F direction. The ring member 146 has an annular shape and is disposed along an edge of the end portion of the movable portion 141 in the +F direction. The ring member 146 rotates together with the movable portion 141.

The ring member 146 protrudes in a direction intersecting the +F direction and toward the axis CA1 inside the movable portion 141. As a result, when transporting of the paper pieces C is stopped by the movable portion 141, the ring member 146 blocks the paper pieces C and inhibits the paper pieces C from unintentionally falling into the above-described opening portion 101*h*.

In a direction from the inner surface of the movable portion 141 toward the axis CA1, a top of each rib portion 141R is lower than a top of the ring member 146.

Figure 6:
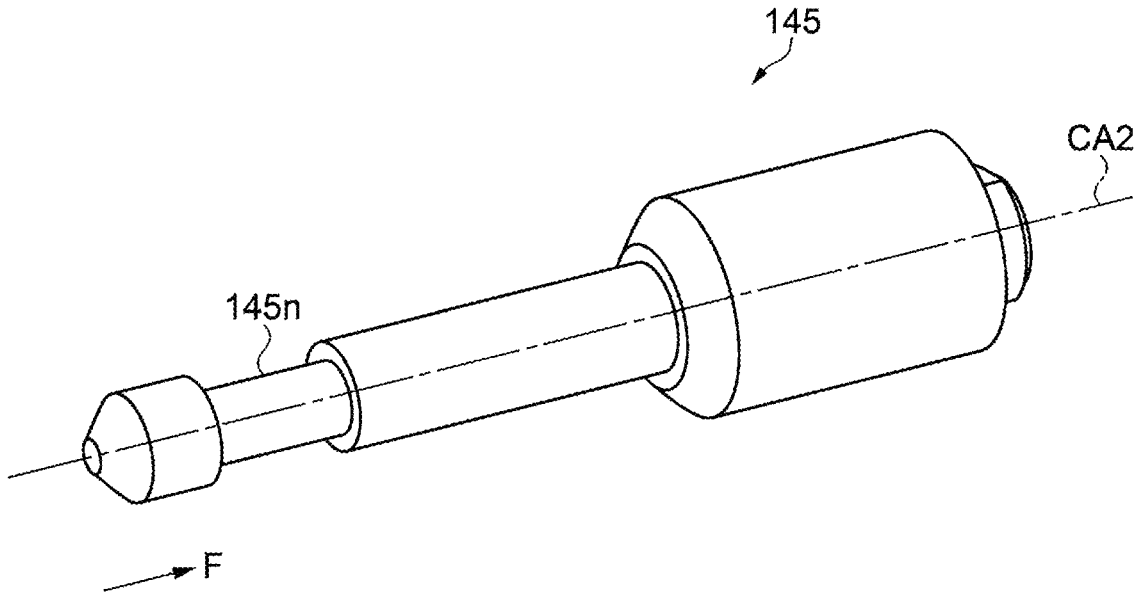
FIG. 6 is a perspective view illustrating an aspect of the fixed portion.

As illustrated in FIG. 6, the fixed portion 145 is rotationally symmetrical with respect to the central axis CA2. The leading end of the fixed portion 145 in the −F direction has a truncated cone shape tapered in the −F direction. Since the leading end of the fixed portion 145 has such a shape, the leading end easily bites into the paper pieces C, and the paper pieces C are easily loosened.

An intermediate portion 145*n* is provided on the +F direction side of the above-described leading end. The intermediate portion 145*n* is formed to be thinner than other regions of the fixed portion 145. The intermediate portion 145*n* is a so-called clearance for ensuring an interval between the fixed portion 145 and the ring member 146 described above. That is, the fixed portion 145 has the intermediate portion 145*n* located at a position facing the ring member 146 and thinner than portions at other positions. Although not illustrated, the fixed portion 145 includes a plurality of regions having different diameters with respect to the central axis CA2, in addition to the intermediate portion 145*n*. The shape of the fixed portion 145 is not limited to the shape illustrated in FIG. 6. For example, the shape of the fixed portion 145 may be a prism shape or a pyramid shape.

Figure 7:
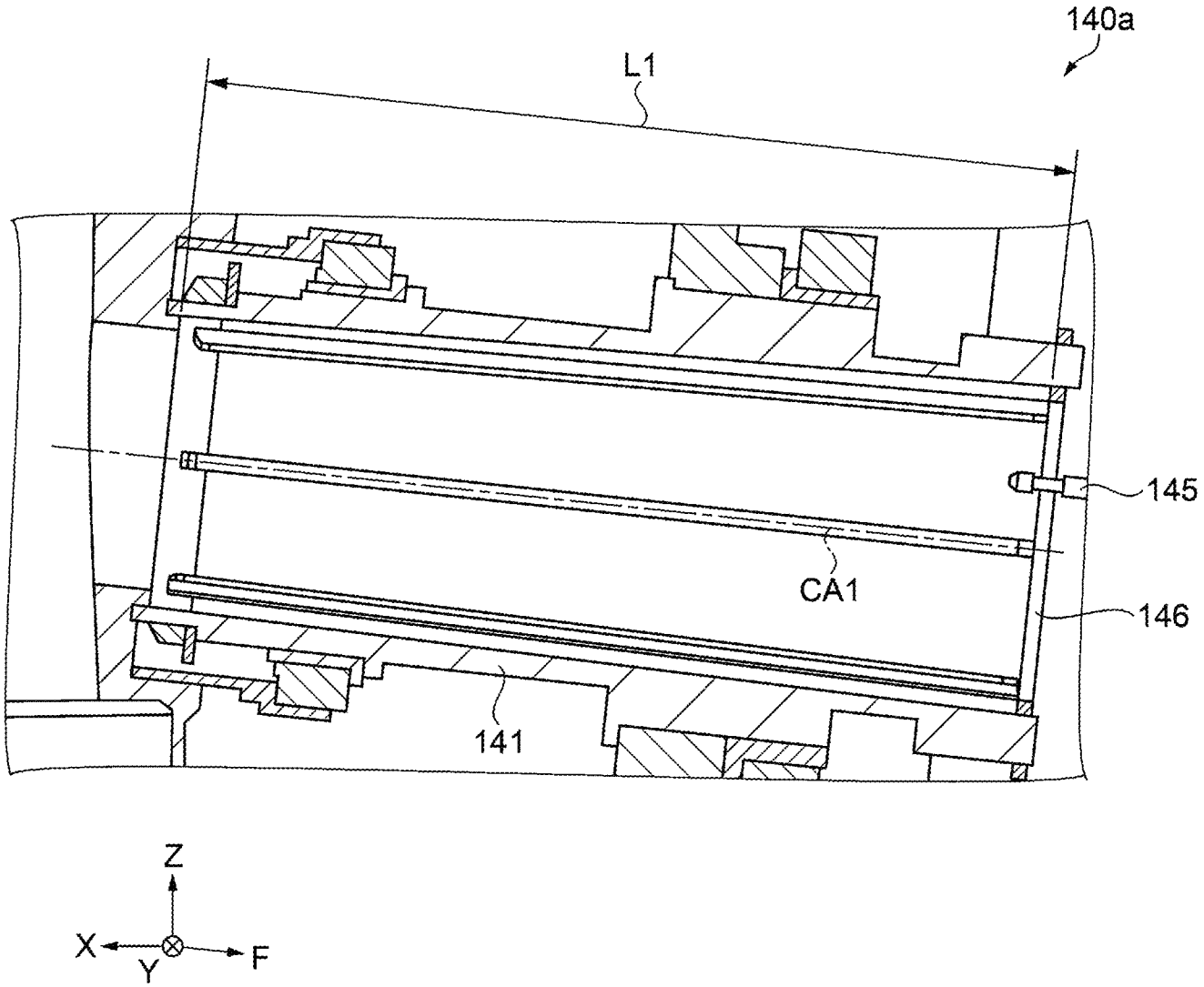
FIG. 7 is a side sectional view illustrating an arrangement of the fixed portion with respect to the movable portion.
Figure 8:
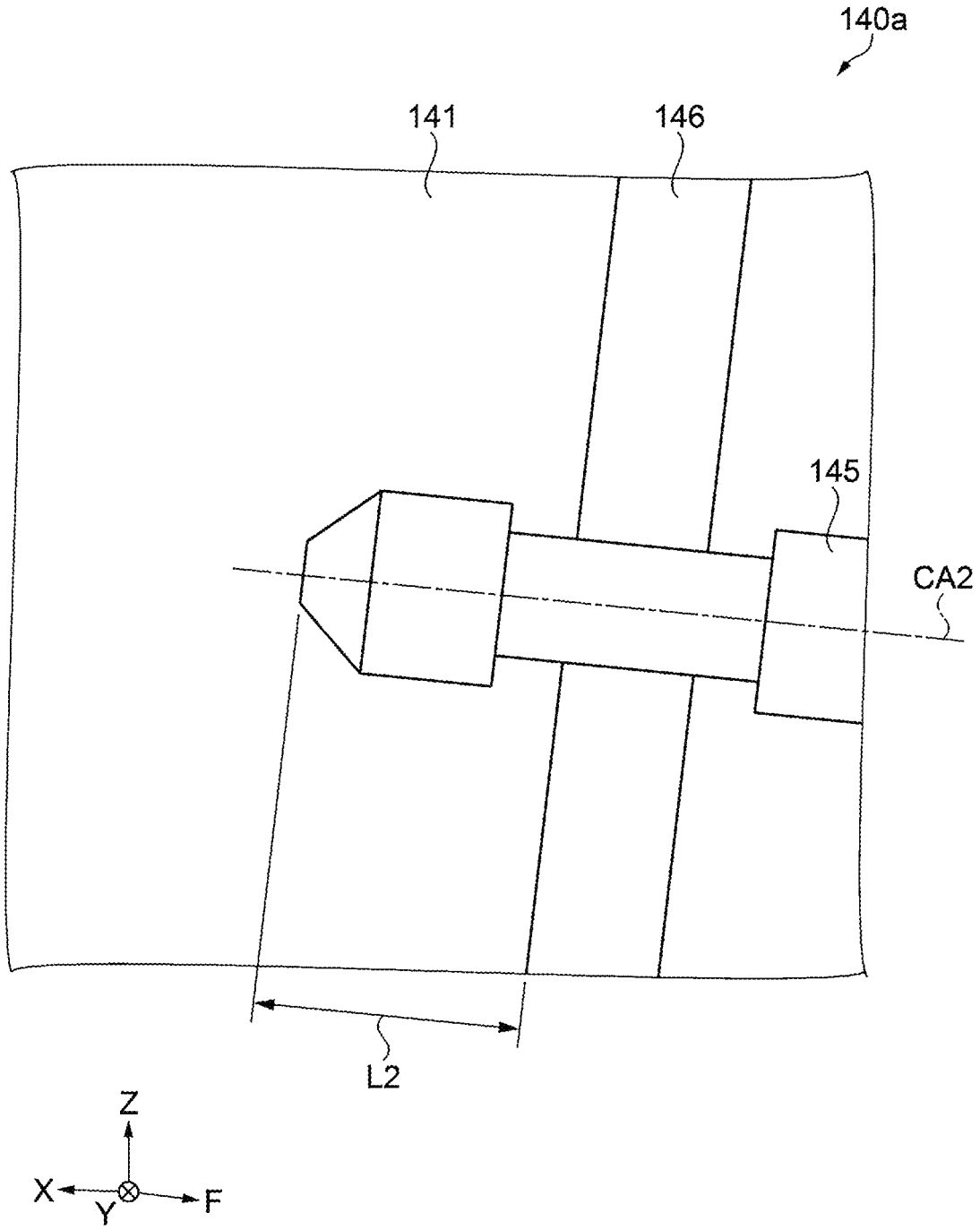
FIG. 8 is an enlarged side view illustrating the arrangement of the fixed portion with respect to the movable portion.

As illustrated in FIGS. 7 and 8, in the +F direction, which is the transport direction of the paper pieces C, a dimension of the movable portion 141 is a length L1, and a dimension of the fixed portion 145 that enters the inside of the movable portion 141 is a length L2. In this case, a ratio L1:L2 of the two lengths is in a range of 120:1 to 120:10. As a result, the paper pieces C do not easily clump together, and even when the paper pieces C are in a lump state, the paper pieces C can be easily loosened, and the transportability of the paper pieces C is further improved. In addition, the paper pieces C are less likely to be caught between the fixed portion 145 and the inner surface of the movable portion 141.

Figure 9:
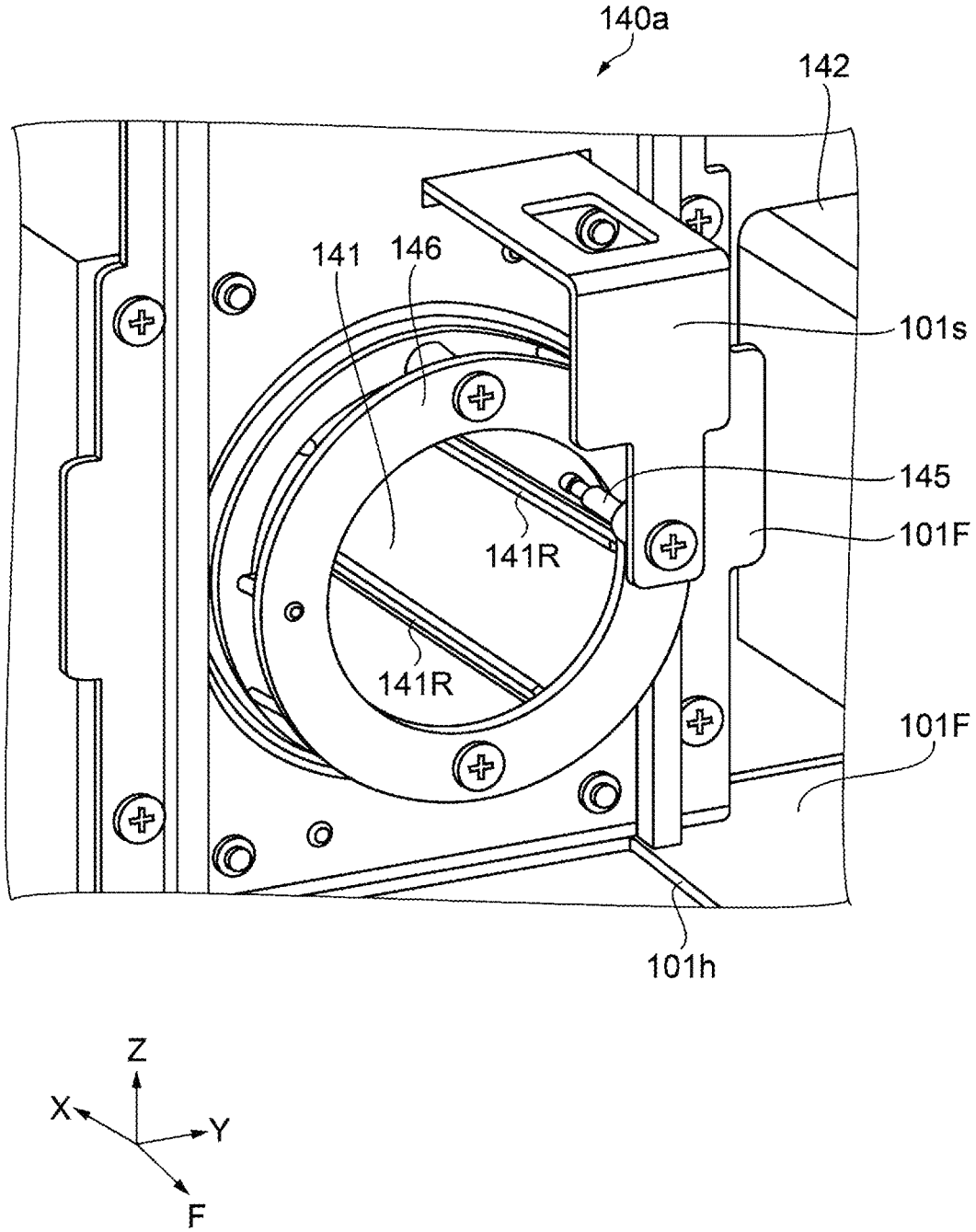
FIG. 9 is a perspective view illustrating the arrangement of the fixed portion with respect to the movable portion.

As illustrated in FIG. 9, the end portion of the movable portion 141 in the +F direction is positioned above the opening portion 101*h*. The paper pieces C discharged from the movable portion 141 fall by gravity, pass through the opening portion 101*h*, and are supplied to the measuring unit 15 (not illustrated in the figure) below the opening portion 101*h*.

The fixed portion 145 is supported by the supporting member 101*s* so as to be suspended from above so as not to hinder the above-described falling of the paper pieces C.

Figure 10:
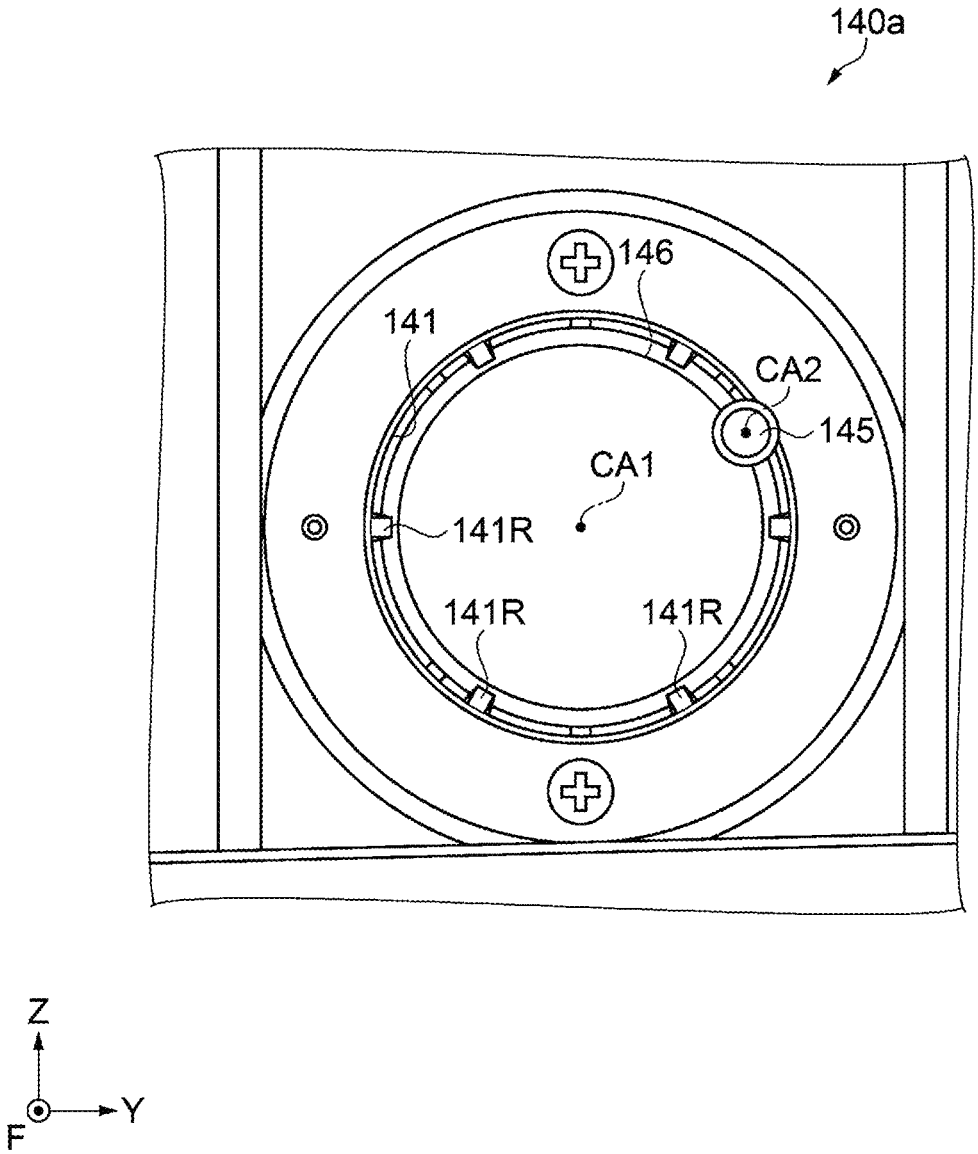
FIG. 10 is a side view illustrating the arrangement of the fixed portion with respect to the movable portion.

As illustrated in FIG. 10, when the movable portion 141 is viewed in the +F direction, and when a vertically downward direction from the axis CA1 of the movable portion 141 is defined as a 6 o'clock direction, the fixed portion 145 is disposed at a 2 o'clock position.

The paper pieces C are transported in the +F direction while the movable portion 141 rotates with respect to the axis CA1. When the paper pieces C are loosened and do not form a lump, the paper pieces C pass through a lower range from approximately 3 o'clock to 9 o'clock by gravity. When the fixed portion 145 is disposed at the 2 o'clock position, the fixed portion 145 does not easily hinder the transporting of the paper pieces C that are not in a lump state. In addition, when the paper pieces C are in a lump state, the paper pieces C also pass through a range other than the above-described range, specifically, an upper range from approximately 9 o'clock to 3 o'clock. Therefore, when the paper pieces C are in a lump state, the paper pieces C are easily loosened by the fixed portion 145. As a result, the transportability of the paper pieces C is further improved.

In a case in which the movable portion 141 is rotated counterclockwise when viewed in the +F direction, the fixed portion 145 is disposed at the 2 o'clock position when the movable portion 141 is viewed in the −F direction, that is, the fixed portion 145 is disposed at the 10 o'clock position when the movable portion 141 is viewed in the +F direction.

Figure 11:
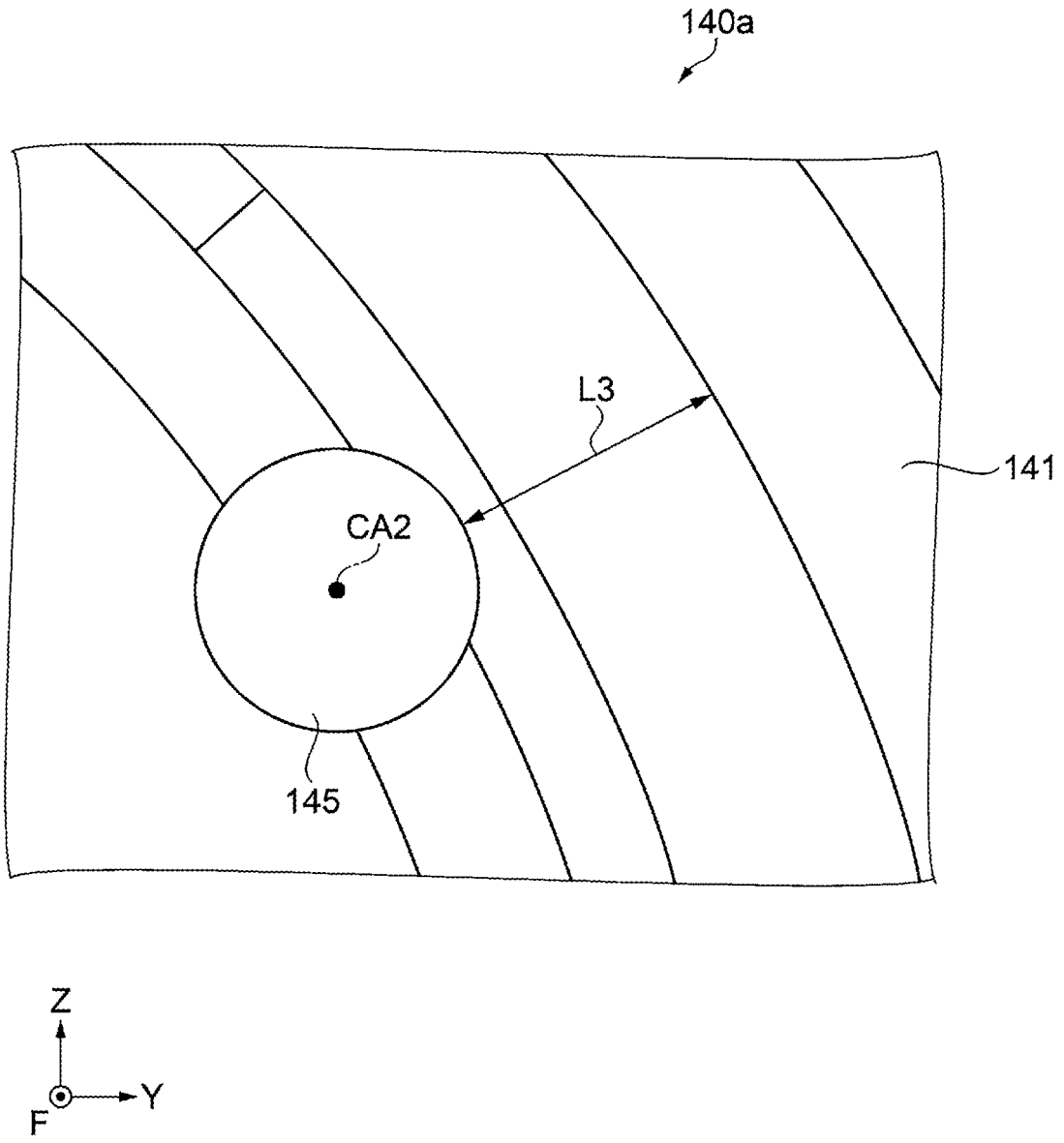
FIG. 11 is an enlarged side view illustrating the arrangement of the fixed portion with respect to the movable portion.

As illustrated in FIG. 11, a distance between the inner wall of the movable portion 141 and a side surface of the fixed portion 145 when viewed in the +F direction is defined as an interval L3. Here, the side surface of the fixed portion 145 is a side surface of a portion having the same diameter as the lower bottom surface of the truncated cone shape at the leading end of the fixed portion 145 described above.

The interval L3 is set so that the fixed portion 145 and the inner wall of the movable portion 141 do not contact each other. Preferably, when a diameter D1 is a diameter of the inner wall of the movable portion 141 at an end portion in the +F direction, the percentage of the interval L3 with respect to the diameter D1 is 5% or more and 30% or less. In addition, when viewed in the +F direction, in a direction from the inner wall of the movable portion 141 toward the axis CA1, a height from the inner wall to the top of the rib portion 141R is less than 5% of the diameter D1. As a result, the paper pieces C do not easily adhere to the inner wall of the movable portion 141, and clogging of the paper pieces C does not easily occur between the inner wall and the fixed portion 145. Therefore, the transportability of the paper pieces C is further improved. The interval L3 may be appropriately changed in accordance with the shape of a single piece of the paper pieces C.

According to the present embodiment, the following effects can be obtained.

The transportability of the paper pieces C can be improved. More specifically, the fixed portion 145 is disposed so as to oppose the flow of the paper pieces C transported inside the movable portion 141. Therefore, the paper pieces C do not easily clump together inside the movable portion 141 and do not easily adhere to the inner wall of the movable portion 141. In addition, when a lump of the paper pieces C is transported, the lump of the paper pieces C is easily loosened and dispersed by the fixed portion 145. Therefore, the raw material supply device 13 that improves the transportability of the paper pieces C can be provided. In addition, the sheet manufacturing apparatus 1 in which a transport path is not easily clogged with the paper pieces C, and the quality of the manufactured sheet P3 is improved can be provided.

What is claimed is:

1. A paper piece supply device comprising:

a storage unit that stores paper pieces;

a tube that discharges the paper pieces from the storage unit;

a motor that rotates the tube; and a fixed portion positioned inside the tube and not movable with rotation of the tube.

2. The paper piece supply device according to claim 1, wherein the fixed portion has a rod shape whose length direction is parallel to a rotation axis of the tube, the fixed portion being located at a position different from the rotation axis of the tube.

3. The paper piece supply device according to claim 1, wherein the fixed portion has a rod shape and has a leading end, on a storage unit side, having a truncated cone shape tapered toward the storage unit side.

4. The paper piece supply device according to claim 1, wherein the fixed portion is away from an opening on a storage unit side.

5. The paper piece supply device according to claim 4, wherein the tube has a substantially cylindrical shape, and when the tube is viewed such that a rotation direction of the tube is clockwise, and when a vertically downward direction from a central axis of the tube is defined as a 6 o'clock direction, the fixed portion is disposed at a 2 o'clock position.

6. The paper piece supply device according to claim 1, wherein an end portion of the tube in a transport direction is provided with a ring that protrudes in a direction intersecting the transport direction and toward an inside of the tube.

7. The paper piece supply device according to claim 6, wherein the fixed portion has a rod shape and is thinner at a position facing the ring than at a position not facing the ring.

8. A sheet manufacturing apparatus comprising:

the paper piece supply device according to claim 1;

a defibrating unit that defibrates the paper pieces discharged from the tube to produce fibers;

an accumulation unit in which the fibers accumulate and form a web in air; and a forming unit that compresses the web to form a sheet.

* * * * *